US007591926B2

(12) United States Patent
Becker et al.

(10) Patent No.: US 7,591,926 B2
(45) **Date of Patent: *Sep. 22, 2009**

(54) PROCESS FOR PRODUCTION ON NONUNIFORMLY INTENSELY COLORED PAPER AND PAPER OBTAINABLE BY SUCH PROCESS

(75) Inventors: Franz Josef Becker, Gladbach (DE); Viktor Uerlings, Düren (DE)

(73) Assignee: M-real Oyj, Espoo (FI)

( * ) Notice: Subject to any disclaimer, the term of this patent is extended or adjusted under 35 U.S.C. 154(b) by 288 days.

This patent is subject to a terminal disclaimer.

(21) Appl. No.: 10/542,463

(22) PCT Filed: Dec. 19, 2003

(86) PCT No.: PCT/EP03/14624

§ 371 (c)(1),
(2), (4) Date: Jul. 14, 2005

(87) PCT Pub. No.: WO2004/063465

PCT Pub. Date: Jul. 29, 2004

(65) Prior Publication Data

US 2006/0185807 A1 Aug. 24, 2006

(30) Foreign Application Priority Data

Jan. 15, 2003 (EP) ..... 03000835

(51) Int. Cl.

| | |
|---|---|
| ***D21H 27/02*** | (2006.01) |
| ***D21H 21/24*** | (2006.01) |
| ***D21H 21/28*** | (2006.01) |
| ***D21H 17/69*** | (2006.01) |
| ***D21H 19/44*** | (2006.01) |

(52) U.S. Cl. ..... 162/162; 162/134; 162/158; 162/164.1; 162/181.1; 162/135

(58) Field of Classification Search ..... 162/134–137, 162/140, 158, 162, 181.1–181.8, 204, 164.1; 428/195.1; 8/445–446, 457, 478
See application file for complete search history.

(56) References Cited

U.S. PATENT DOCUMENTS

| | | | | |
|---|---|---|---|---|
| 1,481,567 | A * | 1/1924 | Senseney | 8/447 |
| 1,650,079 | A * | 11/1927 | Lecjaky | 101/129 |
| 2,031,854 | A * | 2/1936 | Richter | 428/536 |
| 4,543,157 | A * | 9/1985 | Jones et al. | 162/134 |
| 4,581,254 | A * | 4/1986 | Cunningham et al. | 427/244 |
| 4,908,240 | A | 3/1990 | Auhorn et al. | |
| 5,211,747 | A * | 5/1993 | Breton et al. | 106/31.34 |
| 5,240,561 | A * | 8/1993 | Kaliski | 162/138 |
| 5,624,532 | A * | 4/1997 | Trokhan et al. | 162/111 |
| 5,840,403 | A | 11/1998 | Trokhan et al. | |
| 5,891,227 | A * | 4/1999 | Hoffmann et al. | 106/31.28 |
| 6,171,444 | B1 * | 1/2001 | Nigam | 162/158 |
| 6,364,997 | B1 * | 4/2002 | Dagan et al. | 162/9 |
| 6,468,393 | B1 * | 10/2002 | Small et al. | 162/134 |
| 2002/0179266 | A1 * | 12/2002 | Missell et al. | 162/140 |
| 2004/0182532 | A1 * | 9/2004 | Becker et al. | 162/134 |
| 2006/0185807 | A1 * | 8/2006 | Becker et al. | 162/134 |

FOREIGN PATENT DOCUMENTS

| | | | |
|---|---|---|---|
| EP | 0 518 490 | A | 12/1992 |
| EP | 0 732 219 | A | 9/1998 |
| EP | 1 239 077 | A | 9/2002 |
| EP | 1281812 | A1 * | 6/2003 |
| EP | 1439263 | A1 * | 7/2004 |
| EP | 1522629 | A1 * | 4/2005 |
| JP | 61041398 | A * | 2/1986 |
| WO | WO 03/012202 | A | 2/2003 |

OTHER PUBLICATIONS

PTO Translation of "JP-61041398 A," published on Feb. 1986.*

* cited by examiner

*Primary Examiner*—José A Fortuna
(74) *Attorney, Agent, or Firm*—Knobbe Martens Olson & Bear LLP

(57) ABSTRACT

The present invention relates to a process for the production of nonuniformly intensely colored paper with improved printing or lettering features, and paper produced by this process.

16 Claims, No Drawings

PROCESS FOR PRODUCTION ON NONUNIFORMLY INTENSELY COLORED PAPER AND PAPER OBTAINABLE BY SUCH PROCESS

The present invention relates to a process for the production of nonuniformly intensely colored paper with improved printing or lettering features, and the paper produced by this process.

Even in the age of electronic data transmission, there is in general a need for visually appealing papers. It is therefore an objective of the paper industry to produce papers which have an appealing visual effect in addition to high paper quality.

In U.S. Pat. No. 4,534,157, a paper is printed in color in the moist state directly after its production as a paper web, by applying ink via ink nozzles onto an inking roller which then transfers the ink to the paper. Thus, an irregular, diffuse pattern with an ink quantity which remains constant over the paper web is applied to otherwise uncolored paper.

In EP 601 517, white paper is printed in regular or irregular patterns with as little ink as possible. The ink penetrates only to a small extent into the paper. The disclosure of EP 601 157 attaches particular value to the small penetration of the ink into the paper, since the paper is subsequently to be recyclable as white paper. The ink should therefore be capable of being easily removed from the paper.

EP 681 060 describes a process for the production of a differently colored paper, in which cellulose fibers and agglomerates of different thickness are used in the process for the production of the paper and are deposited on or incorporated into the finished paper. The cellulose fibers or agglomerates of different thickness are colored before the deposition on or incorporation into the paper, and are then introduced into the paper pulp, which itself may have a different color.

The methods used to date for the production of patterned papers are either complicated or slow in the production method or lead to papers which achieve a completely different effect.

EP 439 363 discloses a paper which contains a desizing agent or is coated therewith, with the result that better absorption of the ink during the printing of the paper by means of inkjet printing is achieved. The desizing agent is distributed in/on this paper, uniformly over the entire paper surface, in order to obtain an optimum printed copy.

EP 518 490 describes ink which is used for inkjet printing, the ink containing a composition which facilitates the penetration of the ink into the printed paper.

Common to the teachings of EP 439 363 and EP 518 490 is that the penetration of polar liquids, such as inkjet inks, into the paper structure and into the paper fibers of sized paper is facilitated by the suitable use of a desizing agent. However, neither EP 439 363 nor EP 518 490 describes the production of patterned paper by nonuniform coloring of the paper surface.

For increasing the printing and lettering features of base paper EP 1 239 077 proposes to apply a nonionic surfactant with a polyalkoxylene structure.

EP 732 219 discloses a printing medium comprising a liquid-absorbent base material, an ink-receiving layer provided on the base material, which comprises a pigment, a binder and a cationic substance, and a surface layer provided on the ink-receiving layer composed of cationic ultrafine particles as inorganic particles. As the ultrafine particles oxides of metals with a diameter ranging from 1 to 500 nm are described. These particles form a closed glossy surface layer. The pigments contained in the ink-receiving layer are inorganic pigments with a diameter ranging from 0.1 to 20 μm.

It was an object of the present invention to obtain a visually appealing paper of nonuniform coloring with improved printing or lettering features with as little production effort as possible.

This object is achieved by a process for the production of nonuniformly intensely colored paper, comprising a) application of at least one surfactant or a mixture of surfactants in the form of a latent image or pattern to paper, whereby the surfactant(s) is/are mixed with at least one filler (pigment), b) coloring of the paper by means of a dye solution and c) drying of the colored paper.

The invention makes use of the phenomenon of paper sizing and the possibility of subsequently manipulating this in a specific manner in preferred regions on the paper web by applying suitable substances. Papers are as a rule sized for the purpose of avoiding excessive penetration of applied liquids into the paper structure and into the fibers (blotter effect). This is effected during the paper production by adding sizing substances to the aqueous paper fiber slurry before this is shaped into a paper web in the paper machine. The sizing substances are deposited on the fibers to the extent to which the property of liquid absorption of the finished dry paper is desired. This process is known as internal sizing or engine sizing. The achieved extent of liquid absorption is inversely proportional to the "degree of internal sizing" of the paper.

Surface sizing can be carried out instead of or in addition to engine sizing. Here, film-forming substances, such as solutions or dispersions of converted starches, gums and modified polymers, are applied to the already shaped paper web, for example by means of size presses inside the paper machine. The surface sizing also contributes to the strength of the paper, so that high-quality printing paper frequently has engine size and surface size. The presence of a surface size is, however, not essential for the process according to the invention, and it is also possible to use paper which has no surface size.

Alternatively, the process for the production of nonuniformly intensely colored paper in step a) may comprise the application of a dye solution in the form of a visible image or pattern to paper.

Preferred embodiments of the invention are stated in the subclaims.

The production process according to the invention leads to a paper which is solidly colored, the intensity of the color differing within the paper surface. The different intensity of the color results in a visual effect which appears as an image or pattern to the eye.

The image or pattern may be present in the form of a representative image, an imaginative structure, a signet, a regular or irregular pattern, a net structure or an irregular, for example random, distribution of the color on the paper.

The image or pattern can be applied either directly after papermaking, i.e. to the still moist paper, or to a previously produced, dried paper, the paper then being solidly colored by means of an aqueous dye solution. The image or pattern can be applied to a continuous paper web or to individual paper sheets. Preferably, the image or pattern is applied to a continuous paper web.

The image or pattern can be applied by any desired method, in particular by inkjet printing, offset printing, flexographic printing, gravure printing, printing with felt or rubber rollers, by spraying on or manually, the last method being unsuitable for industrial production. Particularly preferred application methods for the image or pattern is application by means of inkjet printing, flexographic printing or gravure printing.

The pattern or image is applied either in the form of a latent image or pattern or in the form of a visible image or pattern to the paper.

For the creation of a latent image or pattern, a substance which influences the penetration of an aqueous dye solution into the paper at the point at which the substance is applied by either facilitating or reducing the absorption, is applied to the paper.

This is achieved by reducing (desizing agent) or increasing (water repellent), by means of the applied substance, the degree of sizing or degree of water repellency achieved by the paper sizing.

Every substance which has this property can be used for the process according to the invention. Surfactants are preferably used for this purpose. Anionic, cationic, nonionic or amphoteric surfactants may be used. In addition to the surfactants, it is possible to use substances which facilitate the penetration of dyes into the paper. Such substances are, for example, glycol ethers, such as ethylene glycol monomethyl ether, ethylene glycol monoethyl ether, ethylene glycol monophenyl ether, diethylene glycol monomethyl ether, diethylene glycol monoethyl ether and diethylene glycol monobutyl ether.

Suitable desizing surfactants can be selected, for example, from (1) hydrophilic polydialkylsiloxanes, (2) polyalkylene glycol, (3) polypropylene oxide/polyethylene oxide copolymers, (4) fatty ester-modified compounds of phosphate, sorbitan, glycerol, polyethylene glycol, sulfosuccinic acids, sulfonic acid or alkylamine, (5) polyoxyalkylene-modified compounds of sorbitan esters, fatty amines, alkanolamides, castor oil, fatty acid, fatty alcohol, (6) quaternary alcohol sulfate compounds, (7) fatty imidazolines, (8) polyether-modified trisiloxanes and (9) mixtures thereof.

Specific examples of water- or alcohol-soluble desizing agents from the abovementioned classes of substances are, for example, (1) poly(oxyalkylene) modifications of (a) sorbitan esters (e.g. Alkamuls PSML-4 (poly(oxyethylene)sorbitan monolaurate), Alkamuls PSMO-20 (poly(oxyethylene) sorbitan monooleate), Alkamuls PSTO-20 (poly (oxyethylene)sorbitan trioleate), Alkaril Chemicals); (b) fatty amines (e.g. Alkaminox T-2, T-6 (tallow amine oxyethylate), Alkaminox SO-5 (soybean amine oxyethylate), Alkaril Chemicals), (Icomeen T-2, Icomeen T-15, ICI Chemicals); (c) castor oil (e.g. Alkasurf CO-10, Alkasurf CO-25B (castor oil oxyethylates), Alkaril Chemicals); (d) alkanolamide (e.g. Alkamide C-2, C-5 (coconut oil alkanolamide oxyethylates), Alkaril Chemicals); (e) fatty acids (e.g. Alkasurf 075-9, Alkasurf 0-10, Alkasurf 0-14 (oleic acid oxyethylates), Alkasurf L-14 (lauric acid oxyethylates), Alkasurf P-7 (palmitic acid oxyethylates), Alkaril Chemicals); (f) fatty acid alcohol (e.g. Alkasurf LAN-1, LAN-3, Alkasurf TDA-6, Alkasurf SA-2 (linear alcohol oxyethylates), Alkasurf NP-1, NP-11, Rexol 130 (nonylphenol oxyethylates), Alkasurf OP-1, OP-12 (octylphenol oxyethylates), Alkasurf LA-EP-15, Alkasurf LA-EP-25, Alkasurf LA-EP-65 (linear alcohol oxyalkylates)); (2) hydrophilic poly(dimethylsiloxanes), such as, for example, (a) poly(dimethylsiloxane) provided with a monocarbinol terminal group (PS556, Petrarch Systems Inc.) and poly(dimethylsiloxane) provided with a dicarbinol terminal group (PS555, PS556, Petrarch Systems Inc.); (b) poly(dimethylsiloxane)-b-poly(methylsiloxane/alkylene oxide) copolymers (PS 073, PS 072, PS 071, Petrarch Systems Inc.), Alkasil HEP 182-280, Alkasil HEP 148-330 (Alkaril Chemicals), nonhydrolyzable copolymers containing Si—C bonds; (c) poly (dimethylsiloxane)-b-poly(propylene oxide)-b-poly(ethylene oxide) copolymers (Alkasil NEP 73-70, Akaril Chemicals), a hydrolyzable copolymer containing Si—O—C bonds; (d) polyquaternized poly(dimethylsiloxane) copolymers (which can be obtained by the addition reaction of an α,ω-hydrogenpolysiloxane with epoxides containing olefinic bonds and subsequent reaction of the product with a diamine); (3) fatty imidazolines and their derivatives, such as, for example, (a) Alkazine-0 (oleyl derivative); (b) Alkazine TO (tall oil derivative); (c) Alkateric 2C1B (dicarboxylic acid coconut imidazoline sodium salt), Alkaril Chemicals; (d) Arzoline-4; (e) Arzoline-215, Baker Chemicals; (4) fatty acid esters of (a) phosphates (e.g. Alkaphos B6-56A, Alkaril Chemicals); (b) sorbitan (e.g. Alkamuls STO (sorbitan trioleate), Alkamuls SML (sorbitan monolaurate), Alkamuls SMO (sorbitan monooleate), Alkaril Chemicals); (c) glycerol compounds (e.g. Alkamuls GMO-45LG (glyceryl monooleate), Alkamuls GDO (glyceryl dioleate), Alkamuls GTO (glycerol trioleate); (d) poly(ethylene glycols) (Alkamuls 600 DO (dioleate), Alkamuls 400-ML (monolaurate), Alkamuls 600 MO (monooleate), Alkamuls 600 DL (dilaurate), Alkamuls 600 DT (ditallow), Alkaril Chemicals); (e) sulfosuccinic acid (e.g. Alkasurf SS-O-75 (sodium dioctylsulfosuccinate), Alkasurf SS-DA4-HE (oxyethylated alcohol sulfosuccinate), Alkasurf SS-L7DE (sodium sulfosuccinate ester of lauric acid diethanolamide), Alkasurf SS-L-HE (sodium laurylsulfosuccinate), Alkaril Chemicals); (f) sulfonic acid (e.g. Alkasurf CA (calcium dodecylbenzenesulfonate), Alkasurf IPAM (isopropylamine dodecylbenzenesulfonate), Alkaril Chemicals); (g) alkylamines (e.g. Alkamide SDO (soybean diethanolamide), Alkamide CDE (coco-diethanolamide), Alkamide 2104 (coconut fatty acid diethanolamide), Alkamide CMA (coco-monoethanolamide), Alkamide L9DE (lauryldiethanolamide), Alkamide L7Me (lauryl-monoethanolamide), Alkamide LIPA (laurylmonoisopropylamide), Alkaril Chemicals); (5) quaternary compounds, such as, for example, (a) nonpolymeric quaternized ammonium ethosulfate (e.g. Finquat CT, Cordex T-172, Finetex Corporation); (b) quaternary dialkyldimethyl methosulfate (e.g. Alkaquat DHTS (hydrogenated tallow)); (c) alkoxylated quaternized di-fatty methosulfate (e.g. Alkasurf DAET (tallow derivative)); (d) quaternized fatty imidazoline methosulfate (e.g. Alkaquat T (tallow derivatives), Alkaril Chemicals); (6) water-soluble copolymers of lipophilic poly(propylene oxide) with hydrophilic poly(ethylene oxide), such as, for example, (a) methanol-soluble Tetronic 150R1, Pluronic L-101, Tetronic 902, Tetronic 25R2 (BASF Corporation), Alkatronic EGE-1 (Alkaril Chemicals); (b) water-soluble Tetronic 908, 50R8, 25R8, 904, 90R4, Pluronic F-77, all from BASF Corporation, and Alkatronic EGE 25-2 and PGP 33-8 from Alkaril Chemicals; (7) poly(alkylene glycol) and its derivatives, such as, for example, (a) polypropylene glycol (Alkapol PPG 425, Alkapol PPG-4000, Alkaril Chemicals); (b) poly(propylene glycol dimethacrylate), poly(ethylene glycol di acryl ate), poly(ethylene glycol dimethacrylate), poly(ethylene glycol monomethyl ether), poly(ethylene glycol dimethyl ether), poly(ethylene glycol diglycidyl ether) (all from Polysciences); (c) poly(1,4-oxybutylene glycol) (Scientific Polymer Products) and the like.

Preferred desizing agents include linear alcohol oxyethylates (e.g. Alkasurf LA-EP-65, LA-EP-25 and LA-EP-15 obtainable from Alkaril Chemicals), nonylphenol oxyethylates (e.g. Alkasurf NP-11 obtainable from Alkaril Chemicals and Rexol 130 obtainable from Hart Chemicals), octylphenol oxyethylates (e.g. Alkasurf OP-12 obtainable from Alkaril Chemicals), oleic acid oxyethylates (e.g. Alkasurf 0-14 obtainable from Alkaril Chemicals), poly(dimethylsiloxane)-b-poly(propylene oxide)-b-poly(ethylene oxide) copolymers (e.g. Alkasil NEP 73-70 obtainable from Alkaril Chemicals), castor oil oxyethylates (e.g. Alkasurf CO25B obtainable from Alkaril Chemicals), coco-imidazolinedicarboxylic acid sodium salts (e.g. Alkateric 2C1B obtainable from Alkaril Chemicals) and coconut fatty acid diethanolamide (e.g. Alkamid S104 obtainable from Alkaril Chemicals). The Alkasurf desizing agents are advantageously biodegradable.

Suitable surfactants imparting water repellency are, for example, paper sizes, such as alkylsuccinic anhydride (ASA), alkylketene dimer (AKD) and polyolefins (e.g. SÜDRANOL 200, Süddeutsche Emulsions-Chemie GmbH, Mannheim, Germany), waxes, wax-like substances, metal soaps (stearates), paraffin and paraffin emulsions, fatty acids, fatty acid (methyl) esters, fatty alcohols, fatty alcohol polyglycol ethers and the sulfates thereof.

During application to the paper, the surfactants are present in the form of solutions, emulsions or dispersions, which further may contain soluble dyes as mentioned below, and/or further auxiliaries in addition to surfactants. Conventional auxiliaries are thickeners, such as, for example, gum arabic, polyacrylates, polymethacrylates, polyvinyl alcohols, hydroxypropylcellulose, hydroxyethylcellulose, polyvinylpyrrolidone, polyvinyl ether, starch, polysaccharides and the like, optical brighteners, brightener quenchers, pigments (dying or non-dying pigments, including pigments with a metallic effect or metals), binders, preservatives and safety chemicals, such as, for example, fluorescent, phosphorescent or luminescent substances. The surfactants are preferably present as an aqueous or alcoholic solution.

The concentration ranges for the surfactants in the solutions, emulsions or dispersions to be applied are 0.01 to 30% by weight, preferably 0.1 to 25% by weight, particularly preferably in the range from 0.2 to 15% by weight.

According to the present invention the applied solution, dispersion or emulsion contains further at least one filler (or pigment), which is selected from oxides of metals or semimetals as for example magnesium, calcium, aluminium, zinc, chromium, iron, copper, tin, lead or manganese. Preferred pigments are silica, gibbsite, bayerite, nordostrandite, boehmite, pseudoboehmite, diaspore, alumina, particularly corundum, alumina hydrate, magnesium silicate, basic magnesium carbonate, titanium (di)oxide, zinc oxide, aluminium silicate, calcium carbonate, talc, clay, hydrotalcite, inorganic matters such as diatomite, organic matters such as resinous pigments made of urea-formalin resins, ethylene resins, styrene resins, acrylate resins or combinations thereof.

One aspect of the invention is that the fillers (pigments) used have a large surface area. The particles themselves, however, have a diameter ranging from 1 to 500 nm, preferably from 10 to 100 nm.

The addition of the filler to the solution, emulsion or dispersion effecting the latent image or pattern has the effect that the printing or lettering on that parts of paper which are treated with the surfactant is improved. By treating the paper with a surfactant later applied ink disperses on that parts which are treated (bleeding, feathering). This effect is reduced by simultaneously applying the surfactant and a filler, since less surfactant is necessary for obtaining the same image or pattern effect when simultaneously a filler is applied. Due to less amount of surfactant(s) less dispersing of the printing or lettering ink is observed. The ratio of filler and surfactant in the applied solution, emulsion or dispersion is 1:0,08 to 1:0,9, preferably 1:0,09 to 1:0,5, more preferably 1:0,1 to 1:0,4 referred to the solid parts (dry).

The applied fillers (pigments) preferably are non-colored, more preferably are transparent and they have a diameter which is so small that no reflection or light dispersion is obtainable. The preferred average diameter of the particles is less than 0.1 μm. Therefore the pigments form a colloidal solution in aqueous systems.

Particularly preferred are cationic fillers, which means that the pigments have positive charge on their surface. Those having negative charge on their surface like silika may also be used if they are surface-treated to change the negative charge on the surface to a positive charge. The positive charge on the cationic surface effects a increased binding of negatively charged dyes of the following dying bath. In this preferred embodiment nonionic surfactants are used in mixture with the cationic fillers.

The concentrations of the thickeners which can be used as surfactant auxiliaries are in the range from 0 to 5% by weight, preferably 0.01 to 2.5% by weight, particularly preferably 0.05 to 2.5% by weight, of the total solution, emulsion or dispersion.

In order to achieve a further special effect on the finished paper, desizing and water repellency-imparting surfactants may also be applied side by side on the same paper surface.

Any desired dye solution can be used for creating a visible image or pattern. An aqueous solution of substantive, basic or acidic dyes, or a mixture of these dyes, is preferably used. Examples of suitable dye solutions are customary printing inks which contain, for example, anthraquinone-, monoazo-, diazo-, phthalocyanine-, aza-(18)-annulene- and formazan-copper complex dyes. Examples of suitable dyes are those mentioned further below for the dye solution of the dyeing bath, including dyes containing or based on pigments as mentioned below.

The concentration ranges of the dyes are 0.1 to 30% by weight, preferably 1.0 to 20% by weight, particularly preferably 2.0 to 10% by weight.

The latent or visible image or pattern can be applied to one side or both sides of the paper so that the finished paper has, at least on one side, a color which is more intense or less intense than in the untreated regions of the paper surface(s).

After the application of the latent or visible image or pattern to the paper, the paper is solidly colored in step (b) with the aid of a dye solution. This coloring is effected so as to cover the whole area, either inside or outside the paper machine, by applying dye solution(s) to the paper by means of classical paper coating apparatuses and processes, such as, for example, a size press, film press, knife coater, blade, rolls or spraying, or by application of a dye solution to the total surface of the paper with the aid of suitable printing methods, such as inkjet printing, offset printing, flexographic printing, gravure printing or printing by means of felt or rubber rollers, by spraying on or by tub coloring of the paper in a dyeing bath. It is preferable to color the paper by the dip process in an aqueous dye solution.

Any dye solution commercially available for these purposes can be used in the present invention. The dye solution usually contains the dyes in concentration ranges of 0.1 to 40% by weight, preferably 0.1 to 35% by weight, very particularly preferably 0.1 to 30% by weight. The concentration of the dye solution can be established according to the individually desired effect to be achieved (intensity of the subsequently desired image).

Corresponding experiments can be carried out by any person skilled in the art by simple testing.

In the dip process, the paper is immersed in an aqueous dye solution after application of the latent or visible image or pattern and is then pressed off and dried. Tub coloring can be carried out using sized or unsized paper webs or paper sheets.

By means of tub coloring, it is possible to obtain rich colors of very high luminous power. A further advantage of this method is that even small amounts can be colored without operating inefficiently.

If a latent image was applied before the coloring of the paper, the paper absorbs the color to a greater or lesser extent in the pretreated areas during the coloring process, depending on the substance with which the paper was pretreated.

The stronger acceptance of the ink in regions which were pretreated with a desizing agent gives the paper on which the image or pattern initially applied in latent form appears in a more intense hue of the same color in which the entire paper is colored. Thus, the color intensity of the image or pattern subsequently appearing as "positive" can be varied by the applied amount and/or composition of the desizing agent applied.

If a water repellent is applied before the coloring of the paper, the image or pattern initially applied in latent form appears, after the coloring of the paper, in a less intense hue of the same color in which the entire paper is colored. Here too, the color intensity of the image or pattern subsequently appearing as "negative" can be varied by the applied amount and/or composition of the water repellent applied.

For the production of the latent image, it is also possible to apply desizing and water-repellent substances side by side on the same paper surface, so that the finished paper has both "positive" and "negative" images or patterns.

In order to obtain one of the effects described so far, it is essential to carry out the coloring of the paper after the application of the substance influencing the ink absorption.

If a visible image or pattern is applied before the coloring of the paper, the subsequent coloring of the paper intensifies the color of the previously applied image or pattern, so that a special effect, namely the nonuniformly intense coloring of the paper, can also be achieved thereby. This effect can be obtained only if the paper carrying the visible image is additionally colored.

Customary aqueous dye solutions can be used for coloring the paper. These may contain basic and/or acidic and/or substantive dyes. Examples of suitable dye solutions are solutions which contain anthraquinone-, monoazo-, diazo-, phthalocyanine-, aza-(18)-annulene- and formazan-copper complex dyes. Specific examples of suitable dyes are mentioned in EP-A 559 324, on page 4, lines 25 to 53. These are in particular triphenodioxazines, Bernacid Red 2BMN; Pontamine Brilliant Bond Blue A; Pontamine; Food Black 2; Carodirect Turquoise FBL Supra Conc. (Direct Blue 199), obtainable from Carolina Color and Chemical; Special Fast Turquoise 8GL Liquid (Direct Blue 86), obtainable from Mobay Chemical; Intrabond Liquid Turquoise GLL (Direct Blue 86), obtainable from Crompton and Knowles; Cibracron Brilliant Red 38-A (Reactive Red 4), obtainable from Aldrich Chemical; Drimarene Brilliant Red X-2B (Reactive Red 56), obtainable from Pylam, Inc.; Levafix Brilliant Red E-4B, obtainable from Mobay Chemical; Levafix Brilliant Red E-6BA, obtainable from Mobay Chemical; Procion Red H8B (Reactive Red 31), obtainable from ICI America; Pylam Certified D&C Red #28 (Acid Red 92), obtainable from Pylam; Direct Brill Pink B Ground Crude, obtainable from Crompton & Knowles; Cartasol Gelb GTF, obtainable from Sandoz, Inc.; Tartrazine Extra Conc. (FD&C Gelb #5, Acid Yellow 23), obtainable from Sandoz; Carodirect Yellow RL (Direct Yellow 86), obtainable from Carolina Color and Chemical; Cartasol Yellow GTF Liquid Special 110, obtainable from Sandoz, Inc.; D&C Yellow #10 (Acid Yellow 3), obtainable from Tricon; Yellow Shade 16948, obtainable from Tricon, Basacid Black X34, obtainable from BASF, Carta Black 2GT, obtainable from Sandoz, Inc.; Direct Brilliant Pink B (Crompton-Knolls); Kayanol Red 3BL (Nippon Kayaku Company); Levanol Brilliant Red 3BW (Mobay Chemical Company); Levaderm Lemon Yellow (Mobay Chemical Company); Spirit Fast Yellow 3G; Sirius Supra Yellow GD 167; Cartasol Brilliant Yellow 4GF (Sandoz); Pergasol Yellow CGP (Ciba-Geigy); Dermacarbon 2GT (Sandoz); Pyrazol Black BG (ICI); Morfast Black Conc A (Morton-Thiokol); Diazol Black RN Quad (ICI); Luxol Blue MBSN (Morton-Thiokol); Sevron Blue 5GMF (ICI); Basacid Blue 750 (BASF); Bernacid Red, obtainable from Berncolors, Poughkeepsie, N.Y.; Pontamine Brilliant Bond Blue; Berncolor A.Y. 34; Telon Fast Yellow 4GL-175; BASF Basacid Black SE 0228; the Pro-Jet series obtainable from ICI, including Pro-Jet Gelb I (Direct Yellow 86), Pro-Jet Magenta I (Acid Red 249), Pro-Jet Cyan I (Direct Blue 199), Pro-Jet Schwarz I (Direct Black 168), Pro-Jet Yellow 1-G (Direct Yellow 132), Aminyl Brilliant Red F-B, obtainable from Sumitomo Chemical Co. (Japan), the Duasyn line of "salt-free" dyes obtainable from Hoechst, such as Duasyn Direct Schwarz HEF-SF (Direct Black 168), Duasyn Schwarz RL-SF (Reactive Black 31), Duasyn Direct Gelb 6G-SF VP216 (Direct Yellow 157), Duasyn Brilliant Gelb GL-SF VP220 (Reactive Yellow 37), Duasyn Acid Yellow XX-SF VP413 (Acid Yellow 23), Duasyn Brilliant Rot F3B-SF VP218 (Reactive Red 180), Duasyn Rhodamine B-SF VP353 (Acid Red 52), Duasyn Direct Turkisblau FRL-SF VP368 (Direct Blue 199), Duasyn Acid Blue AE-SF VP344 (Acid Blue 9), and the like, and mixtures of these dyes.

Further dyes can be used which contain or are based on pigments (dying or non-dying pigment), including pigments with metallic effect, or metals.

The concentration of the dye depends on the manufacturer and also on the color used and is not limiting for the present invention.

The dye solutions can moreover contain further additives, such as alcohol, thickeners, wet-strength agents, optical brighteners, preservatives, safety chemicals, binders and pigments (dyes or non-dying pigments, like for example calcium carbonate). Auxiliaries for the dye solution are in particular gum arabic, polyacrylate salts, polymethacrylate salts, polyvinyl alcohols, hydroxypropylcellulose, hydroxyethylcellulose, polyvinylpyrrolidone, polyvinyl ether, starch, polysaccharides and the like. Further customary additives for inks may likewise be present. Such customary additives are mentioned in EP-A 518 490, page 4, line 55, to page 5, line 9.

The process according to the invention is to be explained in more detail below by the following examples, without it being intended to limit the invention to the embodiments described here.

EXAMPLES

A paper having a basis weight of 105 g/m$^2$ is produced on a Fourdrinier machine. The paper stock composition consists of 80% by weight of softwood sulfate pulp and 20% by weight of eucalyptus sulfate pulp. The paper sizing is carried out using rosin size and alum. 1% of melamine/formaldehyde resin is used as the wet-strength agent. The paper used in the example has no surface size.

The stated percentages of the nonfibrous additives are based on the fiber content. Sheets are taken from the paper thus produced, and desizing (example 1) or water-repellent (example 2) or both (example 3) substances are applied in the form of handwritten characters to said sheets manually with the aid of an application apparatus, for example a Fineliner (Rotring Rapidograph 0.35 mm diameter), reed pen or brush.

In example 4, a visible image is applied to the paper. The sheets treated in this manner are colored by dipping in a dye solution, then pressed off with an absorptive paper mat and dried.

Example 1 to 8

Application of a latent image using a desizing agent and a filler:

An aqueous solution of surfactant(s) is applied as described above to a paper sheet. The subsequent coloring is effected by dipping the paper sheet into a 1.0% strength by weight aqueous Cartasol Blau 3RF solution (Sandoz Chemikalien AG, Basle/Clariant (Deutschland) GmbH, Lörrach). The latent characters are very clearly visible and appear positive and in an intense hue in the same color in which the entire paper is colored.

After drying the paper something is written or printed on the paper and the result is visibly determined.

The used compounds are:

TEGOPREN 5847: A polyether-modified trisiloxane (nonionic surfactant from GOLDSCHMIDT), HYDROPALAT 120 EXP: An EO/PO-modified fatty alcohol, modified fatty alcohol polyglycolether (nonionic surfactant from COGNIS/Henkel), TYLOSE H 30000 YP2: Hydroxyethylcellulose (nonionic thickener from CLARIANT)

TYLOSE H 60000 YP2: Hydroxyethylcellulose (nonionic thickener from CLARIANT)

WALOCEL CRT 30000: Sodium-Carboxymethylcellulose (anionic thickener from Wolff Walsrode, BAYER)

LUDOX CL: Colloidal silica with positive particle charge as filler/pigment (from Grace Davison).

TABLE 1

The amounts are given in parts per weight

| | Example | | | | | | | | |
|---|---|---|---|---|---|---|---|---|---|
| | 0 | 1 | 2 | 3 | 4 | 5 | 6 | 7 | 8 |
| composition | | | | | | | | | |
| Tegopren W 5847 | 3.0 | 3.0 | 1.0 | 0.5 | — | — | — | — | — |
| Walocel CRT 30000 | 0.2 | — | — | — | — | — | — | — | — |
| Hydropalat 120 EXP | — | — | — | — | 2.0 | 1.0 | 0.5 | 0.5 | |
| Tylose H 30000 YP2 | — | 0.2 | 0.2 | 0.2 | — | — | — | — | — |
| Tylose H 60000 YP2 | | — | — | — | 0.2 | 0.2 | 0.2 | 0.2 | 0.2 |
| Ludox CL | — | — | 10.0 | 10.0 | 10.0 | 10.0 | 10.0 | — | 10.0 |
| Water | 96.8 | 96.8 | 88.8 | 89.3 | 87.8 | 88.8 | 89.3 | 99.7 | 89.8 |
| Bleeding | | | | | | | | | |
| (HP990Cxi) IJ/Black | Strong | Strong | no | no | no | no | no | no | no |
| Ink (fountain pen) | Strong | Strong | no | no | no | no | no | no | no |
| Dying bath | | | | | | | | | |
| Dying intensity | Strong | Strong | Strong | Even Strong | Strong | Strong | Even Strong | weak | Extremely weak |

The invention claimed is:

1. A process for the production of nonuniformly intensely colored paper, comprising:

a) applying by a printing method at least one surfactant or a mixture of surfactants in the form of a latent image or pattern to paper on a continuous paper web, whereby the surfactant(s) is/are mixed with at least one filler (pigment), selected from oxides of metals or semimetals, or inorganic matters, or organic matters, or combinations thereof; wherein the at least one surfactant or a mixture of surfactants are present in the form of any of solutions, emulsions, and dispersions in a concentration ranging between approximately 0.01 to 30 wt. % on the basis of the total weight of the solutions, emulsions, and dispersions; and wherein a ratio of filler to surfactant in the solutions, emulsions, and dispersions ranges approximately from 1:0.08 to 1:0.9;

b) coloring of the paper by means of a dye solution; wherein the dye is present in a concentration ranging between approximately 0.1 to 30 wt. % on the basis of the total weight of the solution; and c) drying of the colored paper.

2. The process as claimed in claim 1, wherein the latent image or pattern is produced by applying the surfactant and the filler (mixture) by means of inkjet printing, offset printing, flexographic printing, gravure printing or printing by means of felt or rubber rollers, by spraying on or manually.

3. The process according to claim 1 wherein the filler is selected from silica, gibbsite, bayerite, nordostrandite, boehmite, pseudoboebmite, diaspore, alumina, particularly corundum, alumina hydrate, magnesium silicate, basic magnesium carbonate, titanium (di)oxide, zinc oxide, aluminium silicate, calcium carbonate, talc, clay, hydrotalcite, inorganic matters, and organic matters.

4. The process as claimed in claim 3, wherein the inorganic matters include diatomite.

5. The process as claimed in claim 3, wherein the organic matters include resinous pigments made of urea-formalin resins, ethylene resins, styrene resins, acrylate resins or combinations thereof.

6. The process as claimed in claim 1, wherein the applied surfactant facilitates the penetration of water-soluble dyes into the paper.

7. The process as claimed in claim 1, wherein the applied surfactant reduces the penetration of water-soluble dyes into the paper.

8. The process as claimed in claim 1, wherein, in step a), both a surfactant which facilitates the penetration of water-soluble dyes into the paper and a surfactant which reduces the penetration of water-soluble dyes into the paper are applied.

9. The process as claimed claim 1, wherein an aqueous dye solution is used in step b).

10. The process as claimed in claim 9, wherein the coloring in step b) is carried out inside or outside a paper machine by applying dye solution(s) to the paper by means of paper coating apparatuses and methods.

11. The process as claimed in claim 10, wherein the paper coating apparatuses methods include at least one of size press, film press, knife coater, blade, rolls or spraying.

12. The process as claimed in claim 9, wherein the coloring in step b) is carried out inside or outside a paper machine by application of a dye solution to the total surface of the paper with the aid of suitable printing methods.

13. The process as claimed in claim 12, wherein the suitable printing methods include at least one of inkjet printing, offset printing, flexographic printing, gravure printing or printing by means of felt or rubber rollers.

14. The process as claimed in claim 9, wherein the coloring in step b) is carried out inside or outside a paper machine by spraying on or by tub coloring of the paper in a dyeing bath.

15. The process as claimed in claim 1, wherein the image or pattern is a diagram, a signet, a regular or irregular pattern, a net structure or any nonuniform color distribution.

16. The process as claimed in claim 1, wherein the metals or semimetals include at least one of magnesium, calcium, aluminium, zinc, chromium, iron, copper, tin, lead and manganese.

* * * * *

UNITED STATES PATENT AND TRADEMARK OFFICE

CERTIFICATE OF CORRECTION

PATENT NO. : 7,591,926 B2
APPLICATION NO. : 10/542463
DATED : September 22, 2009
INVENTOR(S) : Becker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 643 days.

Signed and Sealed this

Twenty-first Day of September, 2010

David J. Kappos

David J. Kappos
*Director of the United States Patent and Trademark Office*